United States Patent [19]

Kogure et al.

[11] 4,115,848

[45] Sep. 19, 1978

[54] METHOD AND SYSTEM OF CONTROLLING PLANTS

[75] Inventors: Yoichi Kogure, Tama; Toshimi Minoura, Fuchu; Toshio Fujiwara, Inagi, all of Japan

[73] Assignee: Tokyo Shibaura Denki Kabushiki Kaisha, Kawasaki, Japan

[21] Appl. No.: 639,980

[22] Filed: Dec. 11, 1975

[51] Int. Cl.[2] ..... G05B 15/02

[52] U.S. Cl. ..... 364/107; 364/110; 364/121; 364/119; 364/120; 364/900

[58] Field of Search ..... 340/172.5; 235/150.21, 235/151.1, 150.1

[56] References Cited

U.S. PATENT DOCUMENTS

| | | | |
|---|---|---|---|
| T920,008 | 3/1974 | Broadwell et al. | 235/151.1 |
| 3,266,023 | 8/1966 | Werme | 340/172.5 |
| 3,555,252 | 1/1971 | Garden | 235/150.1 |
| 3,614,745 | 10/1971 | Podvin | 340/172.5 |
| 3,909,601 | 9/1975 | Yamawaki | 235/150.21 |

OTHER PUBLICATIONS

"Sequencing BTG Startup" by Rinkus, *Instrumentation Technology* pp. 50–54, Dec. 1967.

*Primary Examiner*—Eugene G. Botz

*Attorney, Agent, or Firm*—Stevens, Davis, Miller & Mosher

[57] ABSTRACT

In a method and system of controlling the operation of a plant by means of an electronic computer, the judging conditions and control and supervisory operations corresponding thereto are described in tables from which a plurality of action lists having a standard form of plant state judging conditions plus controlling and supervisory operations are prepared. The contents of the action list are stored in the memory device of the computer. A process signal corresponding to a state of the plant is compared with a reference signal for producing a trigger signal which is used to select a corresponding action list. The content of the selected action list is judged to produce a control signal for controlling the plant.

8 Claims, 12 Drawing Figures

METHOD AND SYSTEM OF CONTROLLING PLANTS

BACKGROUND OF THE INVENTION

This invention relates to a method and system of automatic operation of a plant, and more particularly to a method and system of automatic operation of a plant wherein the running operation procedures of the plant are described in tables thus enabling the automatic operation by using a digital computer of the business type.

The invention is suitable to the control of the automatic operation of a plant of a large scale. For the purpose of description, although the following description is made in terms of a steam electric power generating station it should be understood that the invention is also applicable to other type of plants such as nuclear power electric generating stations as well as chemical plants.

With the recent development of the digital electronic computer system (hereinafter merely called a computer) computers have been widely employed for the automatic operation and supervision of plants and the field of application thereof is widened year after year.

A steam electric power generating plant (hereinafter merely called a plant) generally comprises such principal machines and apparatus as a boiler, steam turbine, generator, transformer and circuit interrupter and a number of auxiliary machines and apparatus. In order to maintain the running state of the plants at the best condition it is necessary to operate these various component elements to meet the requirement of the running state of the plant which varies from time to time by taking into consideration the characteristics of the component elements and the running operation standard of the plant. Accordingly, in order to adequately operate a steam electric power generating plant it is necessary to predetermine the most suitable operation and timing for the state of the plant at various times based on the characteristics of the component elements of the plant as well as the running operation standard. For manual operation of the plant, the required running operations are generally performed by judging the state of the plant and the timing in accordance with the running instruction.

The methods of automatic operation of a plant can generally be classified into three types, viz (1) a subloop control, (2) a wired logic or sequence control and (3) a computer control which can be outlined as follows:

(1) Subloop control

This control is effected by analogue control apparatus and consists essentially of a constant value control or a program control. According to this control switching to the adequate control by watching the general running state of the plant is not effected and the coordination between the controls of the principal machines and the auxiliary machines is not made.

(2) Wired logic or sequence control

This control includes a group of controls for small groups of the component elements such as controls of fire furnace charge, warming of fuel, etc. among the entire controls of the plant. These controls are not feedback controls or closed loop controls but instead comprise a mere combination of a single operation and time. For this reason, at present, the plant operator judges at what time and in what manner should such controls of small groups or sub-systems be made during the operation of the plant.

(3) Computer control

This control of the plant is performed by a computer, and substitutes for the subloop control, wired logic control or sequence control described above, and manual controls effected by the operator under his judgement. Moreover, this control is not only applicable to a non-linear control which is difficult to be made by the subloop control but also can improve the control characteristics thereof.

Thus, although the computer control is extremely advantageous, in order to apply this control system to the overall control of the automatic operation of a plant it is necessary to develop independent control systems for respective component elements because these component elements require most suitable controls and because it is necessary to maintain an adequate coordination between them. Thus, it is necessary to prepare programs for operating the computer which satisfy these requirements.

To substitute a computer for the control operations performed by the plant operator, the following procedures should be followed.

(1) The operating states of the component elements or the temperature, pressure, flow quantity, voltage, current and other factors at various portions of the plant are detected to judge the running state of the plant.

For example, during the starting period of the plant there are such predetermined changes in the state as the completion of the ignition of the boiler, passing steam to the turbine for warming up and acceleration, and connection of the generator to the electric power system by closing the circuit interrupter.

(2) It is necessary to determine the state of the plant at a given time by judging the proceeding of the variations of such states at that time and then determine what operation should be made next time. For example, from the ignition to the warming up it is necessary to perform such preparatory operations as the temperature rise of the boiler, pressure rise of the steam, warming up of the turbine valve and bringing the turbine control valve to the starting position.

(3) Considering a specific operation required for running the plant, it will be noted that the operation consists of a simple pattern. According to this pattern (a) It is necessary to check whether the machine or apparatus is in an operable state or not and whether the machine or the apparatus has already been permitted to operate or not. This check is termed "the condition check before operation".

(b) When the condition (a) is fulfilled a control circuit or apparatus is energized to begin the control.

(c) Whether the operation of (b) has regularly completed or not is checked. This is called "the condition check after completion of the operation".

Taking the starting of the turbine as an example, the operation pattern described above can be described as follows:

(a) Condition check before operation

I. A check to determine whether the turbine mismatch temperature is below a target value or not.

II. A check to determine whether the elongation and elongation difference of the turbine is normal or not.

III. A check to determine whether the "speed up button" of the automatic running panel has been depressed or not.

(b) Operation

I. The target speed of the turbine is set to 400 R.P.M. and the acceleration rate is set to a value $R_{Ac}$ determined by the running schedule.

II. The control is commenced, and the turbine speed is increased to 400 R.P.M. at the acceleration rate of $R_{Ac}$.

III. A message is displayed.

(c) Condition check after completion of the operation

I. A check to determine whether the turning clutch between a driving motor and the turbine has been disengaged or not.

II. A check to determine whether the speed of the turbine has reached 400 R.P.M. or not.

(4) Further, the following supervision and correction operations are necessary for automatic running.

For example, where the vibration of the turbine shaft becomes excessive while the turbine is operating in a dangerous speed range (for example, from 800 to 2100 R.P.M.) the speed is immediately decreased to a safe value, for example, 800 R.P.M.

As has been described hereinabove, the automatic operation of a plant under the control of an electronic computer requires the following procedures.

(1) The plant is operated according to prescribed procedures and rules.

(2) Where the state of the plant which is not the direct object of the control or the state of the plant created as a result of the control becomes abnormal, a correction is made to eliminate such abnormal states.

(3) A supervision or timing for discriminating such abnormal states is judged.

To perform the above described procedures by means of a computer it is necessary to prepare a program for prosecuting such procedures. However, as has been pointed out hereinabove, since a plant generally comprises a number of machines and apparatus having different characteristics and since it is necessary to operate the plant to meet these characteristics while maintaining a satisfactory coordination with the present running state of the plant it is extremely difficult to standardize the program utilized for the automatic operation of the plant. Further, since respective plants differ greatly, it has been the practice to prepare a standard specification and to partially modify the same in accordance with the specifications of the customers, which are different from standards. However, as the types of plants differs greatly labor and time are required to prepare a program for the computer as the capacity of the plant increases. For this reason, it becomes difficult to complete the control system within the term requested by the customer. This problem will now be considered in more detail.

FIG. 1 is a block diagram showing a prior art procedure for preparing a program utilized for automatically starting a plant in which numeral 1 designates a table for the measuring points of the plant containing descriptions regarding the input signal, range, method of measurement, location of alarms, etc., and 2 designates a block diagram of an automatic starting device showing the time flow of the running operation which clarifies the operation procedure. Numeral 3 designates a supervisory function specification and 11, 21 and 31 show the preparation of the flow charts and coding operations of the measuring point table 1, the block diagram 2 of the automatic starting device and the supervisory function specification 12, 22 and 32 showing conversion of the informations into machine words by means of a host computer or a debugging computer. Reference numeral 4 represents an overall adjustment effected by the debugging computer, thereby completing the preparation of the program. 5 shows a modification in terms of the machine words. As shown by arrow 51, a simple modification of the program is effected by the debugging computer 4 whereas extensive modification must be performed before conversion into machine words by 12, 22 and 32 as shown by arrow 52. In this manner, according to the prior art computer control system, modification of the program requires much labor and time. Moreover, the preparation of the flow chart and the coding operation shown by 12, 22 and 32 becomes a voluminous task with an increase in the capacity of the automatic operating system.

As described above, in order to prepare a program for use in an automatic operation it is necessary to firstly prepare a block diagram and then a detailed flow chart.

FIG. 2 shows one example of a block diagram utilized to accelerate a turbine in which symbol RQR means "wait until the condition is satisfied" and AUS means "commencement of supervision". The flow diagram will now be described briefly.

1. Unless a push button commanding speed-up of the turbine is depressed, a lamp contained in the button flickers to await depression thereof.

2. The accleration of the turbine is commenced by setting the target speed of the turbine to 400 R.P.M. and the rate of acceleration to $R_{Ac}$.

3. "Acceleration" and "target speed 400 R.P.M." outputs are produced as the message outputs.

4. The supervision of the control values of the plant variables (for example, G63, T62, etc.) is commenced, where G63 and T62 means conditions to be supervised.

5. The fact that the turning clutch has disengaged is confirmed.

6. The fact that the turbine speed has increased to 400 R.P.M. is confirmed.

7. "Turbine speed 400 R.P.M." output is provided as a message output.

Thus, it is necessary to prepare a procedure diagram or block diagram for operating the plant and then determine the running procedure. When the block diagram is prepared in this manner, the program can be prepared by the preparation of the flow chart and by the coding operation as shown in FIG. 1. However, such method of preparing the program has the following defects.

(a) It is necessary to prepare a new program each time the type of boiler or turbine and the running procedure vary. Thus, it is necessary to prepare the program and to correct the error of the program (debugging) for each plant thereby making it difficult to standardize the program.

(b) It is easy to describe the time flow in the block diagram but is extremely difficult to describe operations requiring logical judgments. Where there are 10 auxiliary machines for one main machine and where seven out of 10 auxiliary machines are operable automatically the description of the automatic system in which the auxiliary machines are started randomly is extremely difficult.

(c) When the block diagram is completed it is necessary to transfer the content thereof to the flow chart.

However, errors would be caused unless those who have prepared the block diagram and the flow chart have sufficient mutual understanding. Further, when the contents of the block diagram are directly transferred to the flow chart the flow chart becomes extremely complicated so that it is impossible to understand it except for those skilled in the computer art.

(d) The chart and the block diagram are not always identical so that lack of the strictness of the flow chart results in a decrease in the reliability of the automatic control system as well as incoincidence of the specification and the actual control system.

(e) Modification of the program is difficult so that when it is desired to make an extensive modification, a new program must be prepared starting from the block diagram.

(f) As described above preparation of the flow chart and the coding operation require much labor and time.

Although the prior art procedure is not perfect as above mentioned, it is still possible to complete an automatic control system. When the system is applied to the operation of an actual plant there will occur a large number of unsatisfactory portions requiring correction or modification. Actually, however, such correction or modification is impossible because it is necessary to send back the system to the manufacturing factory each time such unsatisfactory portion is found. This also delays the overall test run of the plant. For the reason described above, development of a computer control system capable of being readily corrected or modified in the field has been desired.

Although the computer control system is an excellent control system where it is applied to the automatic operation of a plant it is necessary to prepare a block diagram, a flow chart based thereon and to perform coding operation which require much labor and time.

To obviate these difficulties, a Fill-in-the-Blank type table system has been proposed but according to this system, the description and operation of the table are made in terms of combinations of logics and since, 1. The order is mechanical, and 2. For the variation of one input from the plant, only one output is produced, this system involves the following problems making its practical use difficult.

(1) There is no difficult problem so long as the transfer of the plant state is effected during the automatic operation in a range normally acceptable but when the state is transferred to an abnormal state effective control cannot be assured. Moreover, at the time of initiating the control it is extremely difficult to maintain synchronism between the plant and its control system.

(2) It is difficult to construct the control operations in the form of modules which are suitable for a computer acting as the control apparatus.

(3) Since the control system of a plant, especially the boiler of a steam electric power station comprises a multi-variable control system, the linkage between tables is extremely complicated.

(4) The complicated linkage between tables requires a long time for modification of the tables as well as processing of the control operations by the computer, thereby making it impossible to process a multi-variable input control.

SUMMARY OF THE INVENTION

Accordingly, it is an object of this invention to provide a novel method and system of automatic operation of a plant under the control of an electronic computer which can provide smooth operation of the plant at high efficiencies even when the running state of the plant becomes abnormal or when the running state is not stable as in the starting period.

Another object of this invention is to provide an improved control system for the automatic running of a plant wherein action lists in the form of simple module constructions are used to control the operation of the plant under the control of an electronic computer of simple and standard construction.

Still another object of this invention is to provide a flexible and versatile computer control system for the automatic operation of a plant in which the content and scale of the control can readily be added or modified.

A further object of this invention is to provide a novel computer control system for the automatic control of a plant which uses action lists in which the sequence or condition of the running operation of the plant is described with strict logical forms thereby enabling computer control without using such troublesome procedures as the preparation of block diagrams and flow charts and the conversion of informations into machine words specific to the computer.

Still further object of this invention is to provide a novel control system enabling the use of a standard non-expensive computer such as a business computer.

Another object of this invention is to provide a novel control system that can be applied to steam or nuclear power electric generating plants, chemical plants and many other plants that can be process controlled.

It is a feature of this invention to describe the "judging conditions of the plant states" and the "controlling and supervisory operations" corresponding to respective conditions in the form of tables so as to form control packages (hereinafter termed "action lists") having a standard form of "plant state judging condition" plus "control and supervisory operation", and the action lists are combined or interlinked to couple the computer with the plant thereby making it easy to operate the plant under the control of the computer and to manufacture the automatic control system.

The term "judging conditions of the plant states" or "plant state judging condition" is used herein to mean the reference conditions necessary for a computer to judge in what sttes are the present states of the plant.

According to one aspect of this invention there is provided a method of controlling the operation of a plant by means of an electronic computer comprising the steps of describing the judging conditions of the plant states and control and supervisory operations corresponding to respective judging conditions in the form of tables, thereby preparing a plurality of action lists having a standard form of plant state judging conditions plus controlling and supervisory operations; storing the contents of respective action lists in the memory means of the computer; generating a process signal corresponding to a state of the plant; sampling the process signal; comparing the sampled process signal with a reference signal for producing a trigger signal; selecting an action list corresponding to the process signal in accordance with the trigger signal; judging the content of the selected action list for producing a control signal; and controlling the plant in accordance with the control signal.

According to another aspect of this invention there is provided a control system for operating a plant including a plurality of machines and apparatus, said system comprising control drive means for controlling the machines and apparatus; means for detecting the state of the plant for transmitting a process signal representing the state; and control means responsive to the transmitted process signal for applying a control signal to the control drive means; said control means including a memory device for storing an operating condition of the plant and an operation content corresponding to the operating condition; and means responsive to the variation in the transmitted process signal for judging the operating condition stored in the memory device for producing the control signal corresponding to the variation of the operating condition.

According to still another aspect of this invention there is provided a computer control system for a plant, said plant including a process signal transmitter; and said computer comprising process input means connected to receive the process signal; a main memory device including process input writing and judging means for sampling the process input received from the process input means and comparing the sampled process signal with a reference plant state, thereby producing a trigger signal; and an auxiliary memory means connected to the main memory means and containing the memories of a plurality of action lists respectively described with various operating conditions of the plant and the operations corresponding to the operating conditions; said process input writing and judging means being responsive to the trigger signal for selecting an action list corresponding to the process signal and transferring the content of the selected action list to the main memory means, and said operation controlling processing means including means for judging the content of the transferred action list for producing a control signal for the plant.

Each action list is constructed to have a simple module construction of a standard form of plant state judging conditions plus controlling and supervisory operations and comprises operation condition judging means including an interlock which functions to mutually interlock different action lists, and an action state determiner which acts as a condition describing member to judge the condition according to the process signal and the state of the action list; and operation content display means including an operation regarding the process and an operation regarding the combination and the mutual linkage of the action lists.

In this manner, by proper combination and linkage extremely complicated operations of a plurality of machines and apparatus of the plant can be performed successively in a predetermined sequence.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
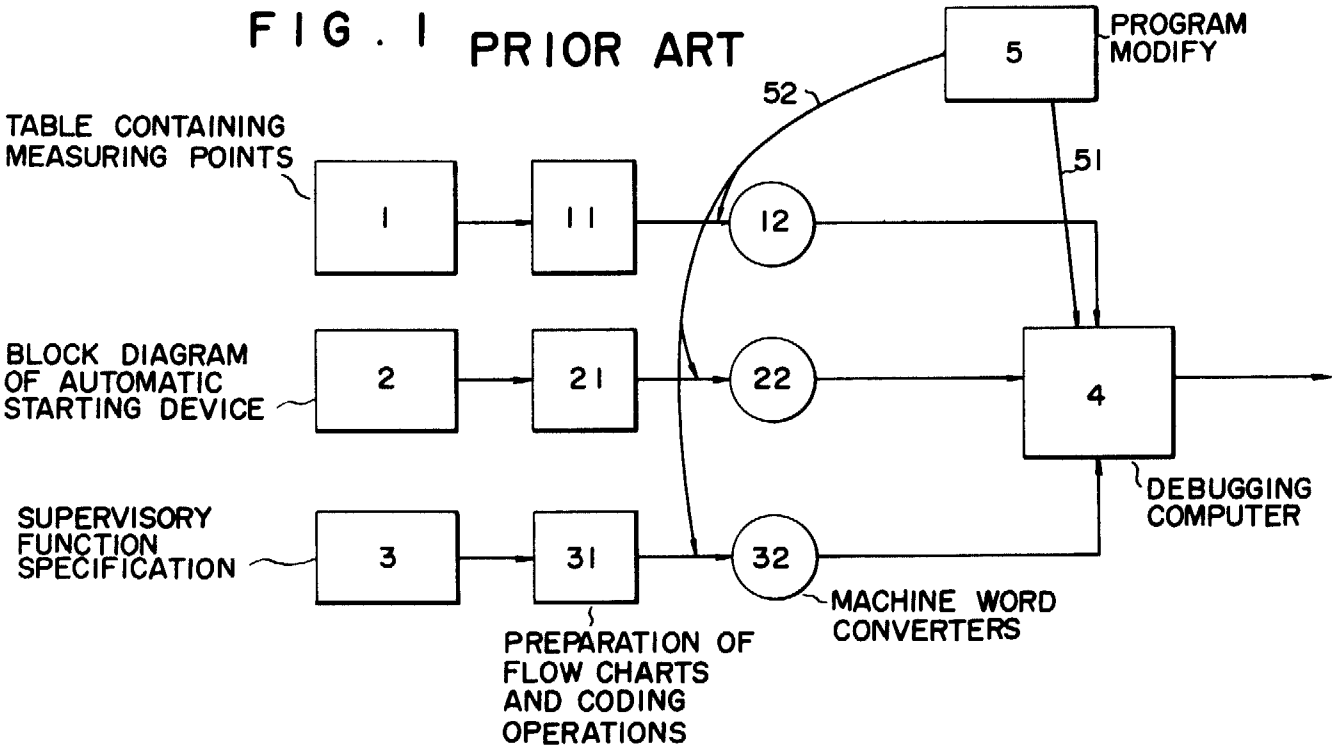
FIG. 1 PRIOR ART
FIG. 1 is a diagram showing a prior art procedure of preparing a program for use in the automatic starting of a plant under the control of an electronic computer.
Figure 2:
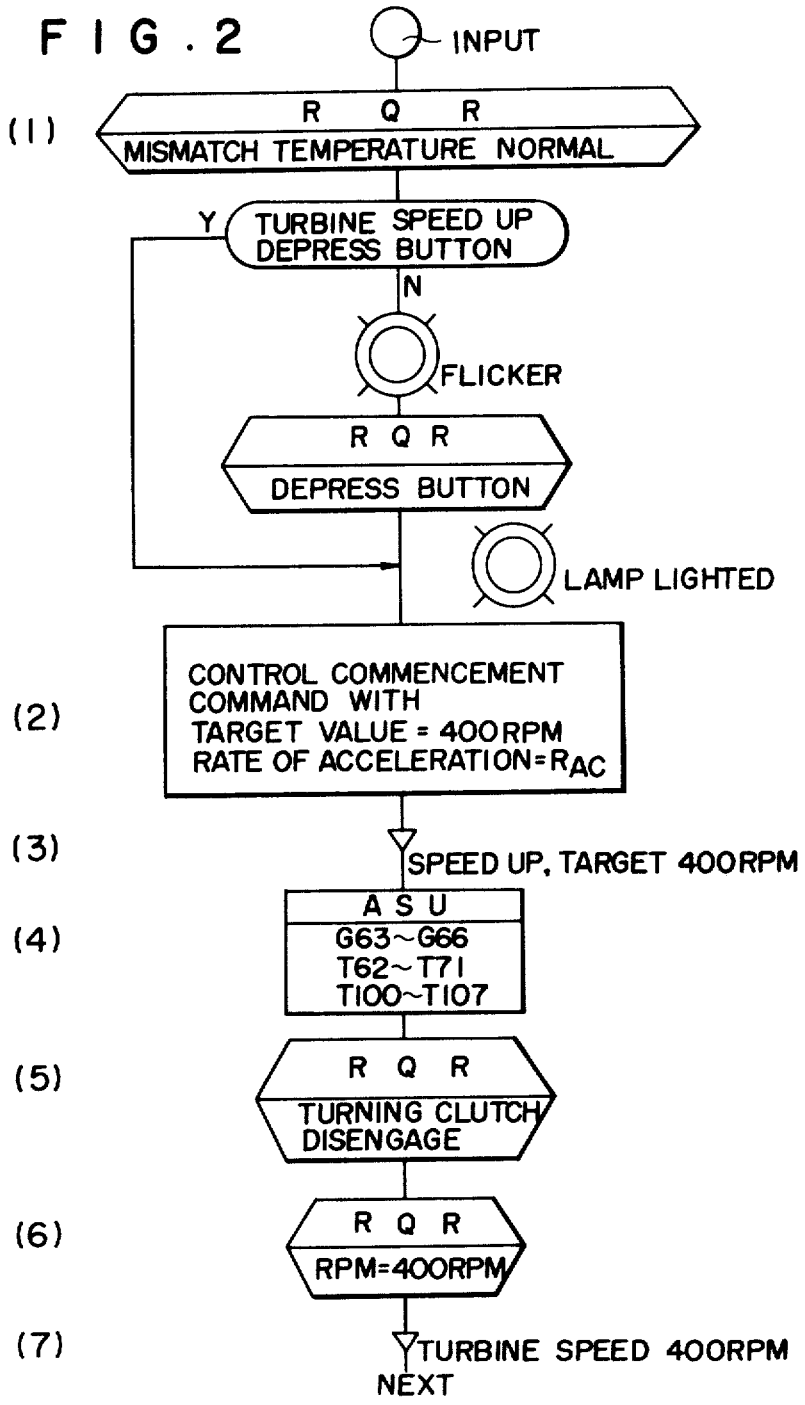
FIG. 2 is a block diagram utilized to accelerate a steam turbine.
Figure 3:
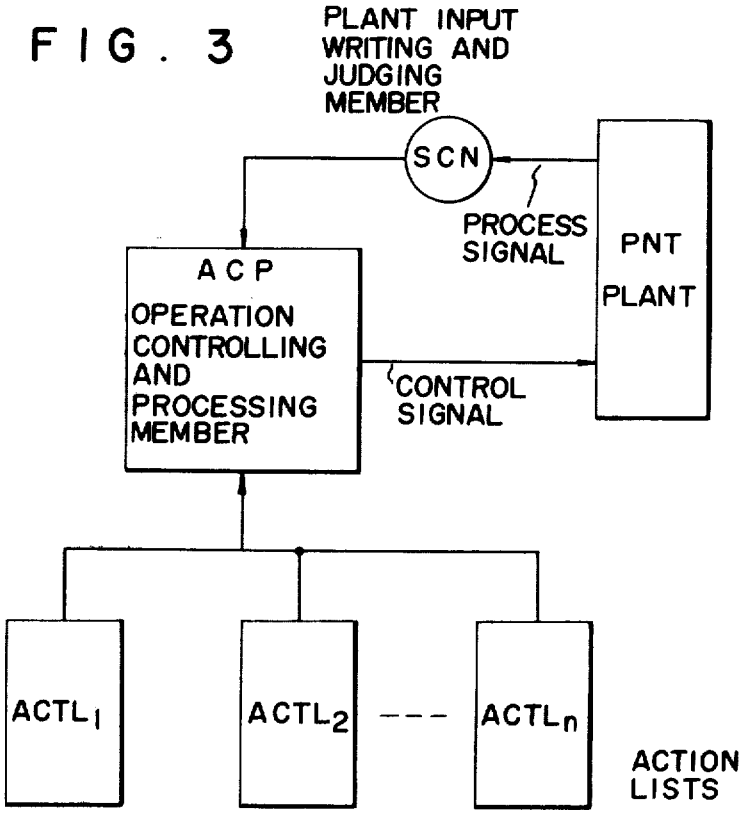
FIG. 3 is a block diagram showing the outline of the control system embodying the invention.

Referring now to FIG. 3 which shows the outline of this invention, the control system illustrated therein comprises a plant to be controlled PNT, a plant input writing and judging member SCN, an operation controlling and processing member ACP and action lists $ACTL_1$, $ACTL_2$—$ACTL_n$, the detail thereof being described later. The running state of the plant is sampled and written at the plant input writing and judging member SCN and the written state is compared with a previously stored plant state. When the written state changes the operation controlling and processing member ACP will produce a trigger signal to derive out a related action list, for example $ACTL_1$. Then the operation controlling and processing member ACP operates to interpret and translate the content of the derived out action list $ACTL_1$ for judging the operating condition. Thus, a control output signal corresponding to such judgement is transmitted to the plant for displaying a desired control and operating an alarm. As will be described later, all contents of the operations are incorporated into the action lists $ACTL_1$ through $ACTL_n$.

The action lists, and the combination and the linkage thereof will now be described as follows.

The outline of the Action List. (ACTL)

The term "action" (ACT) is used herein to mean such control, alarm and display as (1) Drive of an operating end or transmission of a drive command signal to the operating end, (2) Transmission of an alarm message or an operation display message to the operator, and (3) Energization and deenergization of an alarm lamp or a progress display lamp when a condition representing a given plant state changes from not hold to hold or vice versa. Summarizing the above, the term action means transmission of an operation command (change of the limiting value, for example) to the computer which causes a change in the state as will be described later, and the term action list (ACTL) means a basic module in which respective actions described above are stored in a memory device of the computer. As the condition formula of the action (ACT) comprises a combination of a plurality of quantities of the plant states it can be said that an action list (ACTL) is a subsystem which produces one output for a plurality of inputs. Accordingly, as long as the action formulae are the same it is possible to describe a plurality of actions (ACT) in one action list (ACTL) which will be described later.

The Conception of the State.

The term "state" is used herein to mean an analogue quantity of the plant and a quantity representing a process input given by an electric contact signal and the state of a process prepared inside of the computer and can be used as a condition or element of all action lists. The states can be classified as follows.

Type of the State.

Truth: Above a limiting value, contacts ON, ACT condition holds, — etc.

False: Below the limiting value, contacts OFF, ACT condition not hold, etc.

Bad: The term "bad" is used to mean a process signal provided by a detection circuit or apparatus when such detection circuit or apparatus becomes out of order and their detection accuracy falls below a prescribed value, for example interruption of the supply source for the detector and the breakage of the signal line.

Ignore: The term "ignore" means a signal produced for the purpose of not maintaining a process signal at a prescribed state or a state quantity when the state or state quantity is temporarily excluded from the operating condition. Actually, such signal may be produced by the operation of a push button switch or may comprise a combination of process signals.

Questionable: Where a device which produces signals intermittently (not continuously as a scanning device) is used as a detector of process signals applied to the control system, at the time of commencement of the control or at the time of energization of the detector, it is impossible to correctly confirm the type and quantity of the process signals having several hundreds varieties so that the signals produced by the detector and the process signals detected during such period are called "questionable". Thus, the term questionable is used to mean uncertain states but this term is also used in the following cases. Thus, where the process signal comprises an analogue signal its variation is detected by detecting the level. In such a case, if the level of a reference signal which is used as the standard were varied manually or automatically in accordance with the state of the process signal, such process signal would be questionable. Further, when the condition judging means is changed an action (ACT) also becomes "questionable".

According to this invention, the state of the process (including those created in the computer) is used as an element to judge ACT so as to trigger action lists (ACTL) and when the result of judgment of the action lists varies the operation required by the process is performed. The process control system is based on the combination and linkage of the action lists. By using a questionable state it becomes possible to effect a standardized processing.

State Lock: Where a state varies, a certain operation corresponding to such variation is performed in the control system. But where it is impossible to reduce to zero the processing time required to make the states downstream of said state and influenced by the variation thereof the state is locked.

Figure 4:
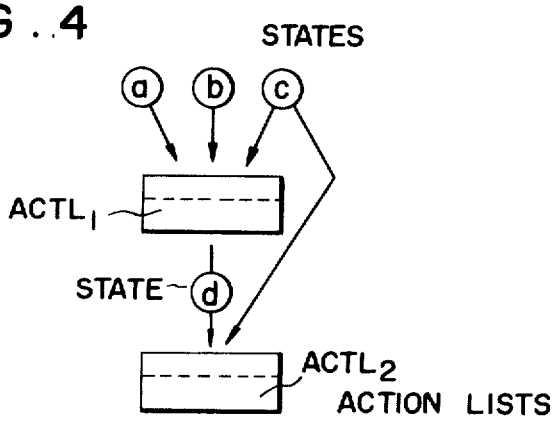
FIG. 4 is a diagram for explaining the relationship between a plant state and an action list.

Having completed the description regarding the type of the states, the relationship between the states and the action lists (ACTL) will now be described briefly with reference to FIG. 4, in which *a, b, c* and *d* represent states and $ACTL_1$ and $ACTL_2$ show action lists, respectively. Upon occurrence of a variation in state *c* the action list $ACTL_1$ and the action list $ACTL_2$ on the downstream side thereof will be triggered. Since each action list ACTL involves "condition judgement" + "operation", downstream action list $ACTL_2$ cannot judge the condition until the judgement of the upstream action list $ACTL_1$ has completed. For this reason, according to this invention when the state *c* varies the state *d* of the upstream action list $ACTL_1$ is judged as "questionable" and the condition judgement of the downstream action list $ACTL_2$ is "blocked" since the state is "questionable". Thus, the action (ACT) itself is considered to be in a "questionable state".

Figure 5A:
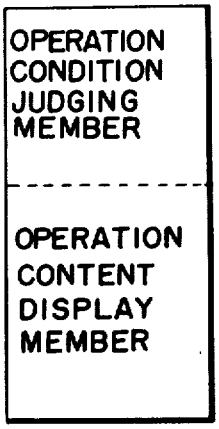
FIG. 5*a* shows the outline of an action list.

FIG. 5*a* is a diagram showing the conception of the action list (ACTL). More particularly, the action list comprises an operation condition judging member (hereinafter called "judging member") and an operation content display member (hereinafter called "operation member").

Figure 5B:
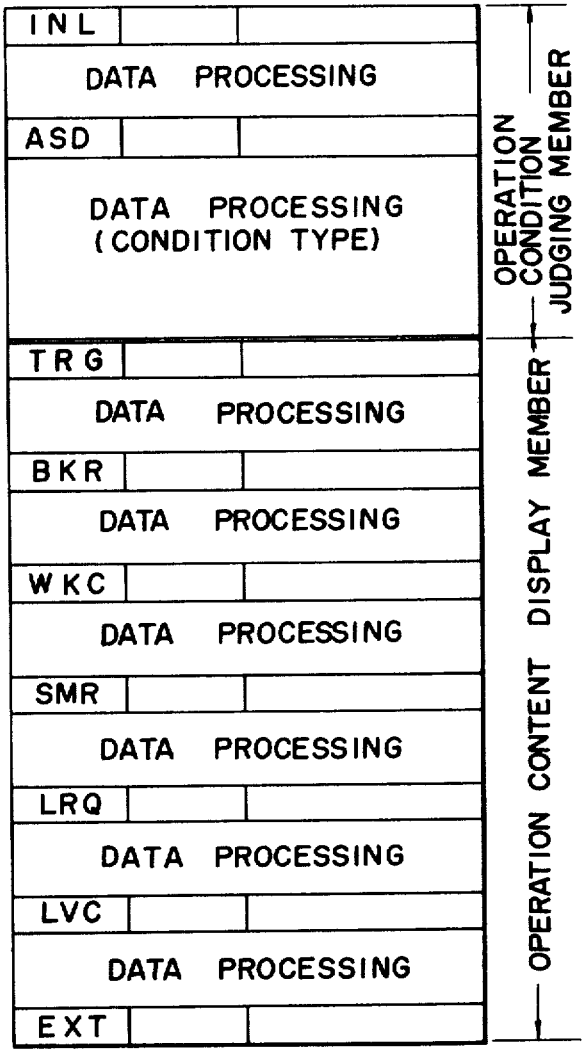
FIG. 5*b* shows a detail of one example of the action list.

FIG. 5*b* shows the detail of one example of an action list. As shown, the judging member comprises an interlock INL and an action state determiner ASD. The interlock INL functions to mutually interlock action lines whereas the action state determiner ASD acts as a condition describing member to judge the condition according to a process signal and the state of an action ACT.

The operation member comprises a worker control WKC, a system message request SMR, a lamp request LRQ, a trigger TRG, a block release BKR, a limit value control LVC and an exit EXT. The operations of the operation member are classified into an operation regarding the process, an operation regarding the combination and mutual linkage of action lists.

Respective operations will be described briefly as follows:

WKC (worker control): Transmits a control signal to a process or a control command signal to the control system.

SMR (system message request): Transmits a message to a machine or apparatus of the plant.

LQR (lamp request): Energize or deenergize a lamp on the automatic running panel.

TRG (trigger): Transmits an operation command to an action list (ACTL).

BKR (block release): Transmits an operation command to an action list blocked in the questionable state.

LVC (limit value control): Varies the alarm set value of an analogue signal or the prescribed value for the operation condition judging member.

EXT (exit): Indicates the termination of an action list.

Each of these elements WKC, SMR . . . comprising an action list has a module construction having a single function and the data processing members are constructed such that they can be readily changed by the action lists.

Figure 6:
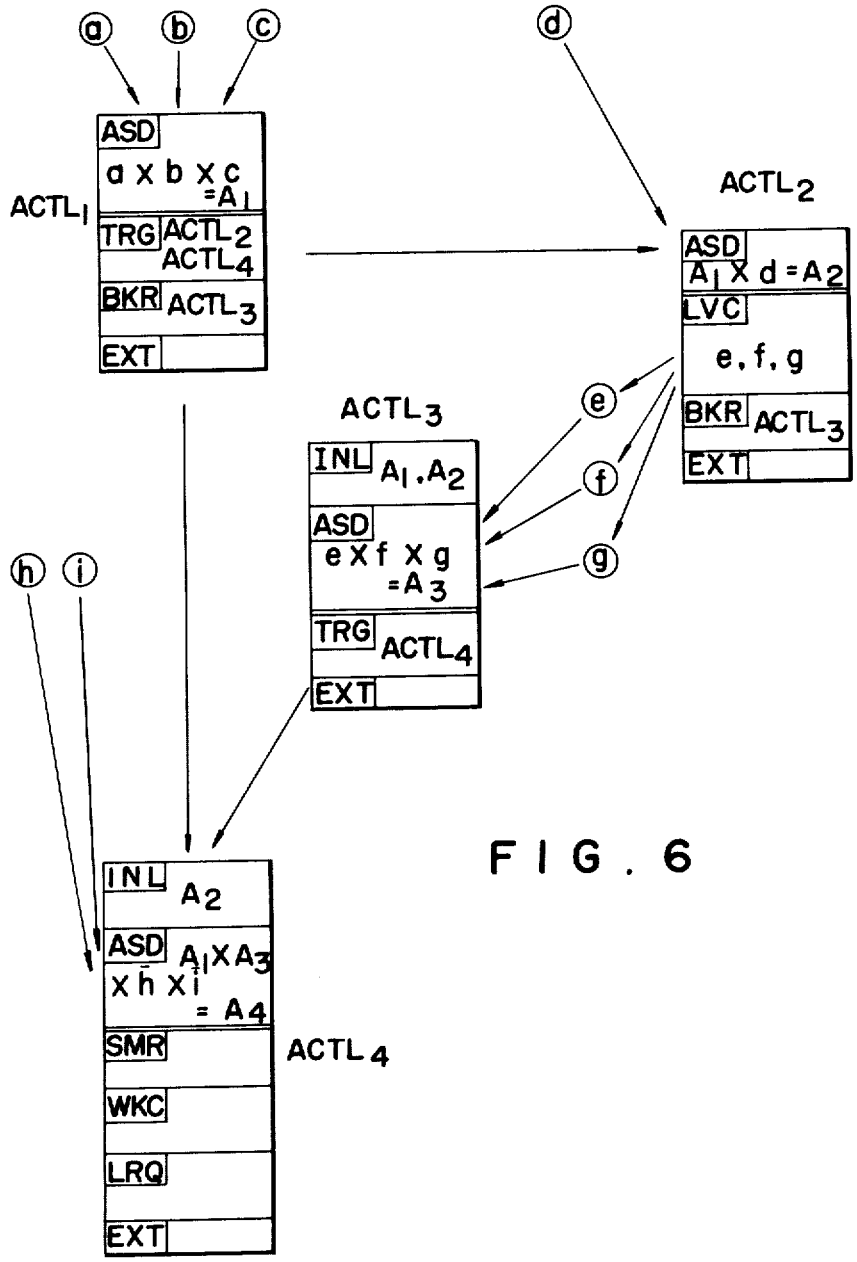
FIG. 6 is a diagram to explain the combination and linkage of the action lists.

A method of combining and interlinking the action lists will now be described with reference to FIG. 6 in which $ACTL_1 \ldots ACTL_4$ represent action lists, respectively, *a, b . . . i* analogue signals or contact signals substituted by states respectively and $A_1$ through $A_4$ the action states of respective action lists.

When any one of states *a, b,* and *c* varies an action list is triggered so that the action state determiner ASD tries to determine an action state $a \times b \times c = A_1$. Suppose now that the state *c* is questionable; then the action list $ACTL_1$ would be blocked to render questionable the action state $A_1$. When the action state $A_1$ is in a questionable state, it is impossible to process action lists $ACTL_2$, $ACTL_3$ and $ACTL_4$. When the questionable state of state $c$ is released a short time later, the action state $A_1$ will be triggered again (block release), thus determining action state $A_1$. When the action state $A_1$ varies, trigger TRG starts or releases action lists $ACTL_2$ and $ACTL_4$, with the result that action states $A_2$ and $A_4$ are rendered questionable. It is not clear which one of action lists $ACTL_2$ and $ACTL_4$ is processed first. If action list $ACTL_4$ is processed first, it will be blocked by the interlock INL thereof because the action state $A_2$ is in a questionable state.

In this manner, according to this invention when a state of an upper order becomes questionable the states of the lower orders are blocked for the purpose of preventing misoperations. In the case described above if the states of action state $A_4$ varies from a not hold to a hold state in the order of $ACTL_1 \rightarrow ACTL_2 \rightarrow ACTL_3 \rightarrow ACTL_4$, the system request message SMR, the worker control WKC, and the lamp request LQR produce a message output, a drive output and a lamp process output respectively in accordance with their contents thus writing in the data processing member of the action list $ACTL_4$. Although the interlock INL is constructed such that it can not act as an element that determines directly action states $A_1$ through $A_4$ but it acts to check a condition which determines whether such condition element can be used as the condition element of the action state determiner ASD, that is whether the action state determiner ASD should be operated or not. In short, the action state determiner ASD functions to judge the condition whereas the interlock INL is used to mutually interlock action lists.

Having now completed the description regarding the action lists, their combination and linkage, the action states and their operation, one embodiment of the novel control system of this invention utilizing these elements will be described with reference to FIG. 7. A digital computer system CPS enclosed by dot and dash lines comprises a process input device PI, a process input writing and judging member SCN, an operation controlling and processing member ACP, an auxiliary memory device AM, a process output device PO, a peripheral apparatus input-output device PER and peripheral apparatus TCK. The plant controlled by the computer system CPS is designated by PNT. PT shows a process signal transmitter, LS an operation display lamp, OA an alarm output device, $CD_1 \ldots CD_n$ control drive devices.

The operation controlling and processing member is included in the main memory device M of the central operating apparatus of the computer CPS whereas the contents of the action lists $ACTL_1 \ldots ACTL_n$ described with various operating conditions and operations corresponding thereto are contained in the auxiliary memory device AM.

Figure 7:
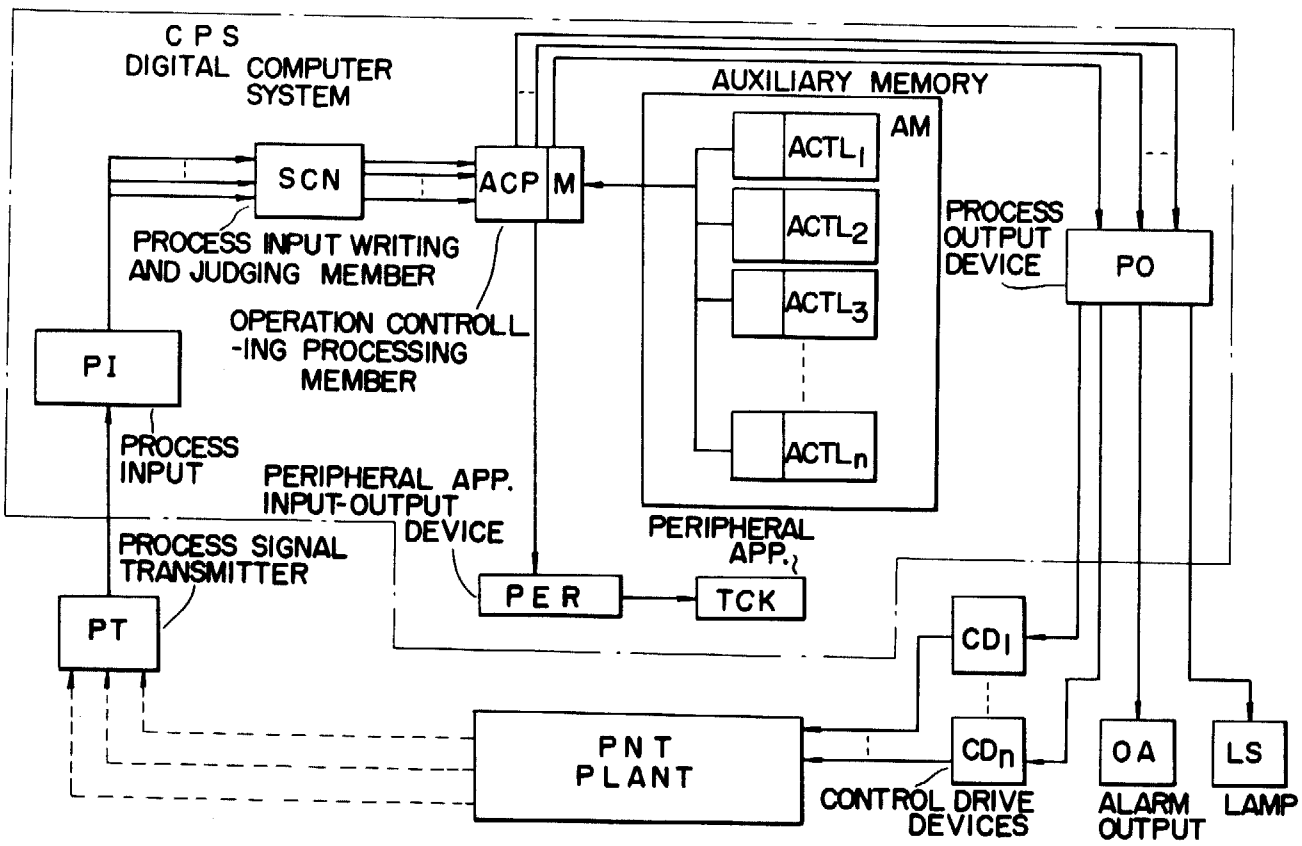
FIG. 7 is a block diagram showing one embodiment of this invention.

Among various elements shown in FIG. 7 those contained in the computer system CPS constitute the essential elements of this invention. Process signals or informations necessary for the automatic running of the plant are converted or coded into machine words for the computer by the process signal transmitter PT and then applied to the process input device PI. The process input applied to the process input writing and judging member SCN from the process input device PI is sampled by the member SCN and compared with a reference plant state previously stored therein. Accordingly, as the state of the plant PNT varies, the process input sampled and written as above described also varies and such variation in the state is detected by the process input writing and judging member SCN. When such state variation is detected the member SCN sends a trigger or start signal to the operation control member ACP for deriving out an action list ACTL which utilizes the state variation for judging the operating condition, whereby action lists, for example $ACTL_1$ and $ACTL_2$, coinciding with said condition are selected from action lists $ACTL_1 \ldots ACTL_n$ contained in the auxiliary memory device and sent to the main memory device of the central operating apparatus of the computer. In this manner, the operation controlling and processing member ACP contained in the main memory device M determines the operating condition in accordance with the descriptions of the action lists $ACTL_1$ and $ACTL_2$ transferred to the main memory device. Thus, upon variation of the operating condition, the contents of the action lists $ACTL_1$ and $ACTL_2$ are interpreted and translated and the result is sent to the outside of the computer via the process output device PO or the peripheral apparatus input-output device PER. The signal from the process output device PO takes the form of an analogue signal or a digital signal which is applied to the operation display lamp LS, the alarm output device OA or the control drive devices $CD_1$ through $CD_n$ according to the output signal. The control signal applied to the control drive devices $CD_1$ through $CD_n$ controls the plant such that the process quantity of the plant will assume a proper state. The output signal from the peripheral apparatus input-output device PER is applied to the peripheral apparatus TCK such as a typewriter thereby forming a permanently visible record.

Figure 8:
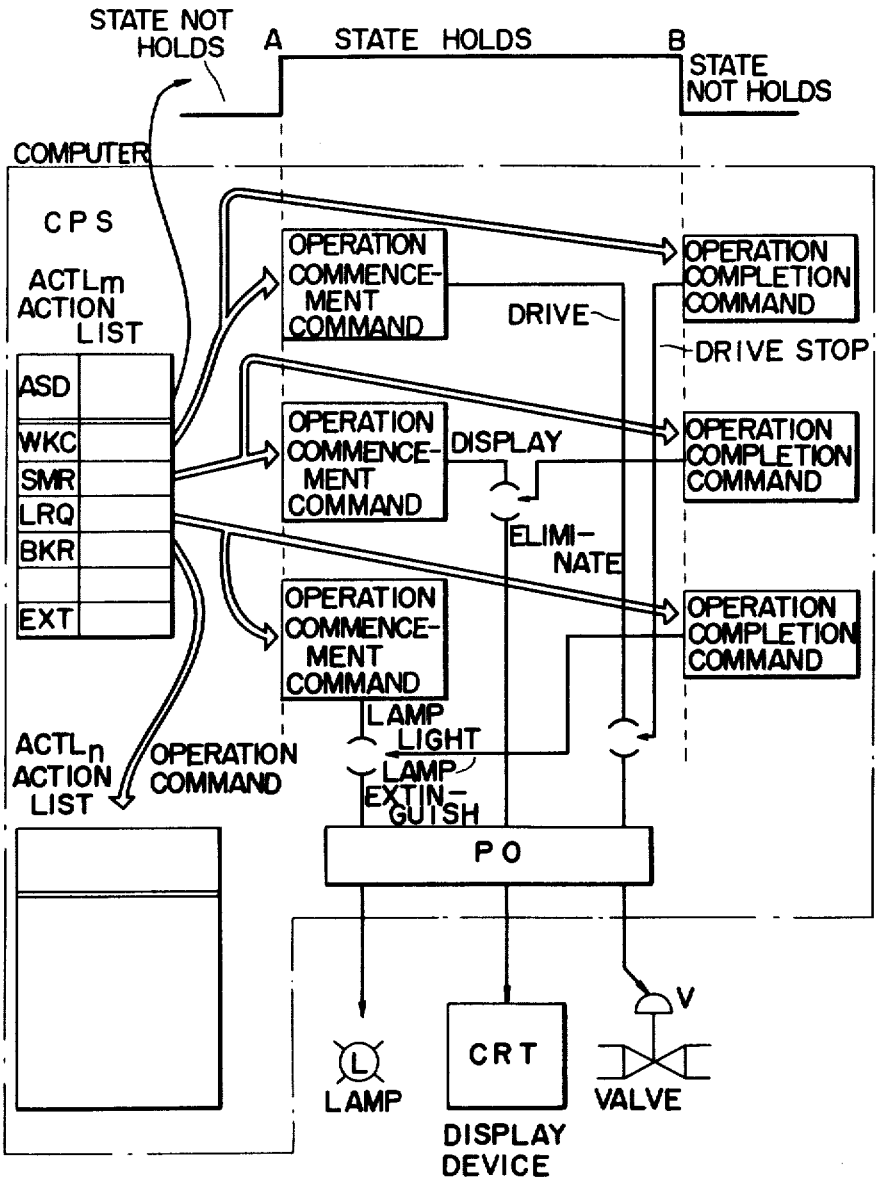
FIG. 8 is a diagram to explain the manner of controlling, displaying and alarming in accordance with an action list.

The detail of the construction and operation of the control system shown in FIG. 7 will now be described with reference to FIG. 8. When a certain state variation is detected by the plant input writing and judging member SCN, a trigger signal is produced which selects an action list, for example $ACTL_m$, that judges the condition in accordance with said state and the state of the selected action list $ACTL_m$ is judged by the operation condition judging member SNC. When a state is established at an instant A, the operation controlling and processing member ACD translates the operation content of the action list $ACTL_m$ thereby producing a command signal corresponding to the content of the action list $ACTL_m$ as shown by thick arrows. More particularly, the worker control WKC drives a valve V, for example, at the instant A, the system message request SMR displays a message on a display device, for example, a cathode ray tube and the lamp request LRQ lights a lamp L. These control and display operations continue until an instant B where the state disappears (or not hold). Then the drive of the valve V is terminated, the display on the display device CRT is extinguished and the lamp L is turned off. In this manner, when the results of condition judgment change at A and B corresponding operations are performed.

Generally speaking when the result of judgment changes from not hold to hold, a start processing is performed whereas in the opposite case a stop processing is performed. Thus, reverse operations are performed at instants A and B but in certain cases, the operation of the control system is stopped while maintaining the present state. However, this can be altered freely by selecting a proper operation content display member.

When the action list $ACTL_m$ is block released, the condition is determined by the action state determiner ASD to apply a trigger or operation command signal to action list $ACTL_n$ that has been blocked.

The action state determiner ASD is constructed to operate under the same condition as an ordinary logical circuit comprising a combination of AND and OR gate circuits or the like which logically judges a plurality of the types of states. It is a feature of this invention to use multi-value logics utilizing a plurality of states.

Figure 9:
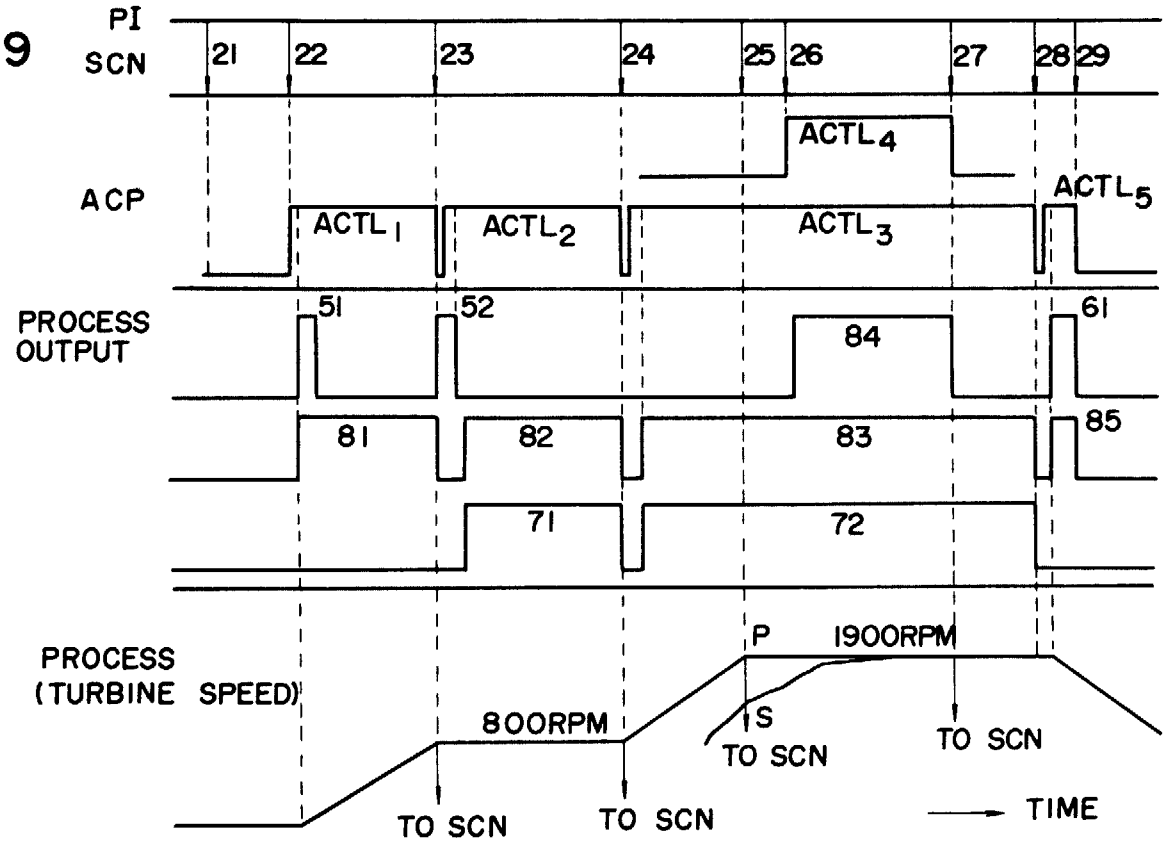
FIG. 9 is a time chart illustrating the application of the invention to the speed control of a twin shaft steam turbine.

The operation of the automatic running control system described above will be described hereunder with reference to the time chart shown in FIG. 9 by taking the process control of the speed of a twin shaft steam turbine as an example. In FIG. 9, curve P shows the number of revolutions of the primary turbine and S that of the secondary turbine. Respective action states of action lists $ACTL_1$ through $ACTL_5$ are as follows:

$ACTL_1$: speed up to 800 R.P.M.

$ACTL_2$: maintain the speed at 800 R.P.M.

$ACTL_3$: speed up up to 1900 R.P.M.

$ACTL_4$: bring the speed of the secondary turbine to 1900 R.P.M.

$ACTL_5$: trip the turbines

The input from the process input device PI is written in the process input writing and judging member SCN and judged thereby detecting a state variation at 21. Thus, the action list $ACTL_1$ is selected and drawn out. However its condition does not hold so that the operation controlling and processing member ACP does not produce any output. By the variation at 22 the action list $ACTL_1$ is selected and drawn out. When its condition holds a process output 51 is produced to perform a control 81 thereby increasing the turbine speed to 800 R.P.M. When the speed reaches 800 R.P.M., an output 23 is produced whereby the condition of the action list $ACTL_1$ does not hold. A process output 52 produced at this time terminates control 81. At this time, action list $ACTL_2$ is selected and drawn out whereby its condition holds to provide an output 71 to the plant thereby beginning a control 82. Above described operations are repeated for effecting the control by translating the contents of the action lists successively selected and drawn out by the operation controlling and processing member ACP. As the control operation proceeds as above described and when a state changes, output 28 which represents a dangerous state of the turbine is produced and the action list $ACTL_5$ is selected and drawn out thus producing an output 61. Thus, a control signal 85 is produced to trip the turbine.

As has been described hereinabove, according to this invention it is possible to perform operations only in accordance with the states of process variables by a combination of action lists. Further, complicated operations can be simplified by forming a new action list by combining and interlinking a plurality of action lists.

Figure 10:
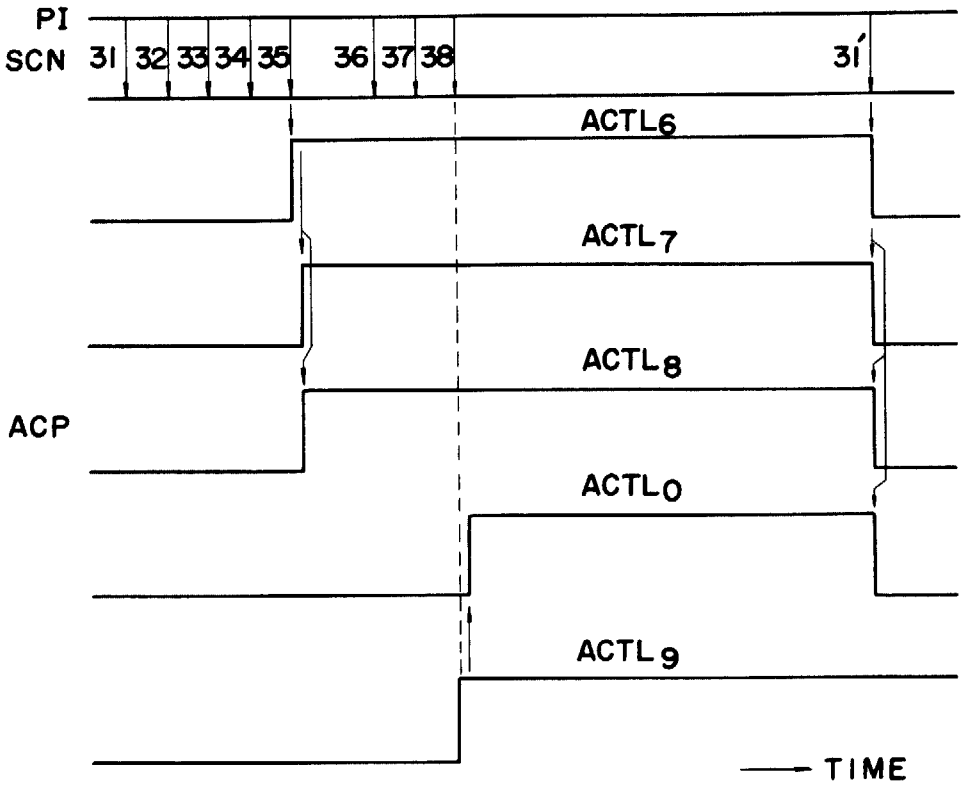
FIG. 10 is a time chart utilized to prepare a new action list by interlinking a plurality of action lists.

This example is shown by the time chart shown in FIG. 10. If the condition of action list $ACTL_6$ holds by the state variation outputs 31 through 35, action lists $ACTL_7$ and $ACTL_8$ are triggered. In this case, action lists $ACTL_7$ and $ACTL_8$ may use the state of action list $ACTL_6$ instead of directly using state variation outputs 31 through 35 thereby simplifying the condition judgment of action lists $ACTL_7$ and $ACTL_8$. When the state variation outputs 36, 37 and 38 hold the condition the action list $ACTL_9$ triggers an action list $ACTL_o$. Since the action list $ACTL_o$ utilizes the state of action lists $ACTL_6$ and $ACTL_9$ for the condition judgment if the conditions of action lists $ACTL_6$ and $ACTL_9$ satisfy AND, the action list $ACTL_o$ would judge that the condition holds at the time of varying the condition of the action list $ACTL_9$.

For the sake of easy understanding, FIG. 10 is described on the assumption that all conditions follow an AND logic but when the state variation output 31 changes to 31' the condition of action list $ACTL_6$ will not hold and hence the conditions of action lists $ACTL_7$, $ACTL_8$ and $ACTL_o$ will also not hold.

The following cases show examples of the operations described above.

$ACTL_7$, $ACTL_8$: opening and closing operations of the turbine drain valve.

$ACTL_6$: the state of the process that performs said opening and closing operations.

$ACTL_9$: identical to $ACTL_6$ but includes an added process state (see $ACTL_o$ below).

$ACTL_o$: assuming that state variations 36, 37 and 38 represent the variation in the value opening caused by the operations based on action lists $ACTL_6$ and $ACTL_7$, the valve is opened or closed during or after the operations caused by action lists $ACTL_6$ and $ACTL_7$.

Although in FIG. 10, the operations of the peripheral apparatus TCK, alarm output device OA, operation display lamp LS, and control drive devices $CD_1$ through $CD_n$ shown in FIG. 7 are not shown it will be clear that these apparatus are operated according to the construction of the associated action lists while the conditions thereof hold or when the states thereof vary.

While the invention has been described in terms of a control system utilizing a digital electronic computer the invention is not limited to the use of a specific type of the computer. The central operating apparatus, memory device, process input-output device, etc. of the computer are generally formed of logical circuits.

Figure 11:
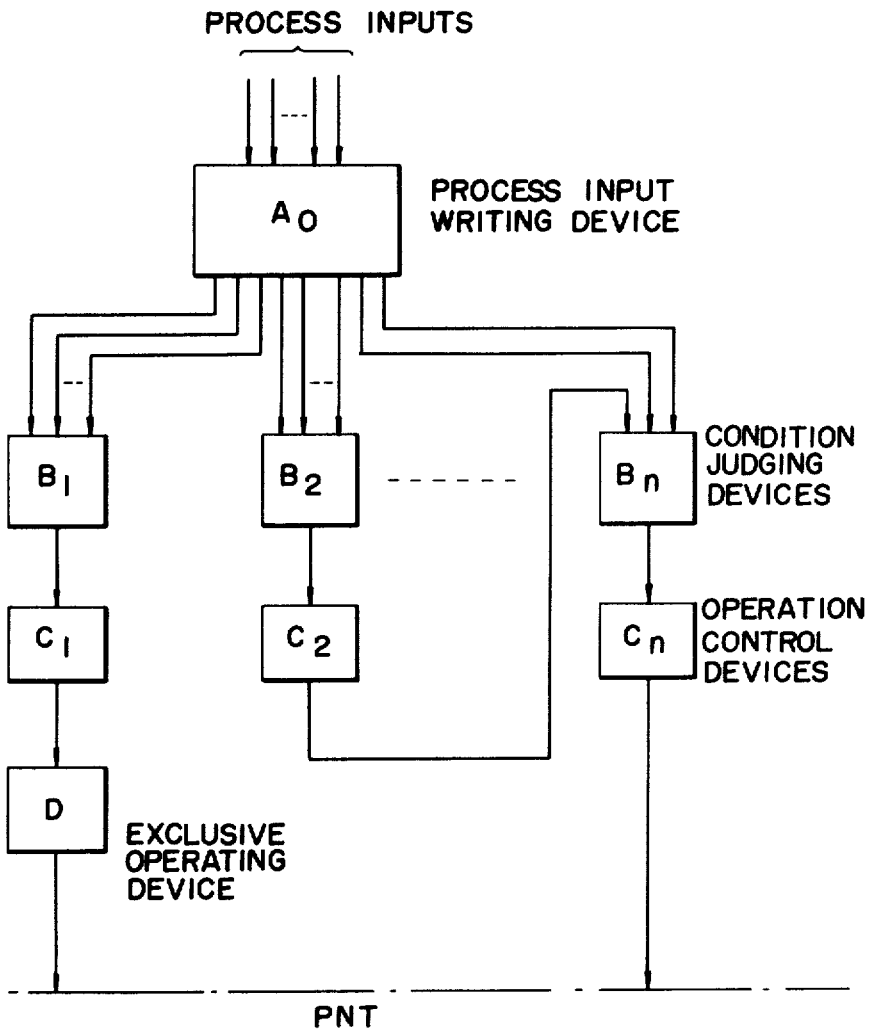
FIG. 11 is a block diagram illustrating another embodiment of this invention.

FIG. 11 is a block diagram showing the connection of a process input writing device $A_o$ such as a scanner, condition judging devices $B_1$, $B_2 \ldots B_n$, operation control devices $C_1$, $C_2 \ldots C_n$ and an exclusive operating device D.

The condition judging devices $B_1$, $B_2 \ldots B_n$ are constructed to perform logical judgment in accordance with the level or variation thereof of the process input level for producing outputs which vary with the outputs from a flip-flop circuit. The operation control devices $C_1$, $C_2 \ldots C_n$ are controlled in accordance with the variation in the outputs from the condition judging devices with the result that apparatus which have been maintained in stand still are started and those that have been operated are stopped. These operation control devices $C_1$, $C_2 \ldots C_n$ are constructed to perform a series of controls consisting of a combination of such individual controls as the lighting and turning off of the display lamp, opening and closing of an electric contact, etc.. The exclusive control device D comprises a control device which exclusively perform such control as a closed loop control which is difficult to be performed by the operation control devices $C_1$, $C_2 \ldots C_n$. The combination and linkage of the action lists can be realized by combining and interlocking the condition judging device C and operation control device $C_1$ or the condition judging device $B_2$ and the operation control device $C_2$.

Although it is theoretically possible to construct the entire control system by using logical circuits and mono-functional apparatus, such arrangement increases the size and cost of the control system thus requiring a large installation space. For this reason, according to this invention only the condition judging devices $B_1$, $B_2$ . . . $B_n$ and the operation control devices $C_1$, $C_2$ . . . $C_n$ are incorporated into the computer thus not only simplifying the construction but also increasing the capacity of the system. Thus by replacing a computer for the most complicated elements which are difficult to construct with logical circuits it becomes unnecessary to use a computer of high grade and large size. In other words, it is possible to use a business computer of simple construction and not expensive.

The control system of this invention for the automatic running of a plant has the following advantages.

1. The operating sequence or conditions of the plant are expressed in the form of readily understandable lists, that is action lists, and the lists are strictly described. By this measure it becomes possible to process the operation of the plant without requiring troublesome processings such as preparation of block diagrams and flow charts and coding of the informations into machine words.

2. Each action list comprises "an operating condition judging section" and "an operation content commanding section" and all operations are described in the list so that it is possible to use the same format for extremely complicated operations. Further, by properly combining and interlinking a plurality of action lists so as to use a state obtained by judging the operating conditions of said action list as a state for preparing a new action list, in other words by infinitely interlinking unit functions it is possible to operate a plant involving complicated operations by using an electronic computer of simple or standard type such as a business computer.

3. The use of the action lists enables independent handling of a plurality of control operations. Moreover, since the operation condition judging section of the action list is described in terms of combinations of logical equations it is possible to strictly define the abnormal state of the plant to run continuously thereby enabling the plant even under an abnormal or unstable condition.

4. The operation content commanding section of each action list comprises a proper number of basic operations, the speciality (for example, the type of the lamp) of each basic operation comprising the variable portion thereof. With this construction it is possible to use in common for different action lists the operation condition judging section which performs the basic operation and condition judgment whereby the control range can readily be widened or varied by mere addition to or changing of the action list. Thus the control system of this invention is flexible and varsatile in that the control content and control scale can readily be varied. Moreover, as the action list is constructed to have a simple module construction suitable for processing the control operations with a computer it is easy to design and manufacture the control system thus enabling a person to design the system even when he has not sufficient knowledge regarding the principle of the system or the computer.

Although the invention has been described in terms of the automatic running of a steam electric generating station it should be understood that the invention is also applicable to any plant whose running sequence can be determined by judging the state of the plant. For example, the invention is also applicable to nuclear power electric generating plants, chemical plants or any other plants which can be process controlled. The invention is especially useful for noncontinuous control systems and factory supervision. The manner of describing the action list is not limited to that illustrated in the embodiment but may be varied to be suitable to control the plant.

Thus, the invention provides a novel control system which greatly widens the range and type of the automatic operation of the plant.

We claim:

1. In a method of controlling the operation of a plant by means of an electronic computer including memory means of the type wherein a process signal corresponding to the operation state of the plant is generated, the process signal being compared with a predetermined reference signal and the plant being controlled by the result of the comparison, the improvement which comprises the steps of predetermining the judging conditions of the plant states and control and supervisory operations corresponding to respective judging conditions in the form of tables, preparing a plurality of action lists having a standard form of plant state judging conditions plus controlling and supervisory operations, storing the contents of respective action lists in memory means of said computer, sampling said process signal, comparing said sampled process signal with a reference signal for producing a trigger signal selecting an action list corresponding to said process signal in accordance with said trigger signal, judging the content of the selected action list for producing a control signal, and controlling said plant in accordance with said control signal.

2. The method according to claim 1 wherein each action list comprises operation condition judging means including an interlock which functions to mutually interlock different action lists, and an action state determiner which acts as a condition describing member to judge the condition according to said process signal and the state of the action list, and operation content display means including an operation regarding the process and an operation regarding the combination and the mutual linkage of the action lists.

3. The method according to claim 2 wherein said operation content display means comprises a worker control providing a control signal to said plant, a system message request sending a message to the machines and apparatus in said plant, a lamp request for lighting and extinguishing a lamp on an automatic running panel, a trigger for producing an operation command signal for said action lists, a block release for providing an operation command for action lists which are blocked in a questionable state, a limit value control for varying the alarm set value or the prescribed value for the operation condition judging means, and an exit indicating the termination of an action list.

4. The method according to claim 2 wherein an action list of the upper order is selected in accordance with said trigger signal while the action lists of the lower orders are blocked.

5. A computer control system for a plant, said plant including a process signal transmitter and said computer comprising process input means connected to receive said process signal, a main memory device including process input writing and judging means for sampling the process input received from said process input means and comparing said sampled process signal with a reference plant state, thereby producing a trigger signal, and an auxiliary memory means connected to said main memory means and containing the memories of a plurality of action lists respectively described with various operating conditions of said plant and the operations corresponding to said operating conditions, said process input writing and judging means being responsive to said trigger signal for selecting an action list corresponding to said process signal and transferring the content of said selected action list to said main memory means, and said operation controlling and processing means including means for judging the content of said transferred action list for producing a control signal for said plant.

6. The computer control system according to claim 5 wherein said computer is of the digital type and further includes means for coding said process signal into a machine word suitable to be processed by said computer.

7. The computer control system according to claim 5 wherein said control signal produced by said operation controlling and processing means is also applied to peripheral apparatus, alarm means and display means.

8. The computer control system according to claim 7 wherein said peripheral apparatus comprises a typewriter thereby forming a permanent record of said control signal.

* * * * *